US005203463A

United States Patent [19]

Gold

[11] Patent Number: 5,203,463

[45] Date of Patent: Apr. 20, 1993

[54] ADJUSTABLE PRODUCT DISPLAY AND DISPENSING UNIT

[76] Inventor: Steven K. Gold, 237 Doyle Ave., Providence, R.I. 02906

[21] Appl. No.: 773,033

[22] Filed: Dec. 9, 1991

[51] Int. Cl.[5] ..... A47F 1/04

[52] U.S. Cl. ..... 211/59.3; 211/184

[58] Field of Search ..... 211/59.3, 59.2, 184, 211/188

[56] References Cited

U.S. PATENT DOCUMENTS

| | | | |
|---|---|---|---|
| 2,980,259 | 4/1961 | Fowlds | 211/59.3 |
| 3,110,402 | 11/1963 | Mogulesau | 211/59.3 |
| 4,300,693 | 11/1981 | Spaner | 211/59.3 |
| 4,762,236 | 8/1988 | Jackle, III et al. | 211/59.3 |
| 4,801,025 | 1/1989 | Flum et al. | 211/188 X |
| 4,901,869 | 2/1990 | Hawkinson et al. | 211/59.3 |

FOREIGN PATENT DOCUMENTS

| | | | |
|---|---|---|---|
| 1237830 | 6/1960 | France | 211/184 |

*Primary Examiner*—Blair M. Johnson

*Attorney, Agent, or Firm*—William Freedman

[57] ABSTRACT

This invention provides an adjustable system for the storage, organization, display, promotion and dispensing of containerized goods, especially those packaged in boxes, jars, bottles and cans. The system is primarily intended for use on supermarket, convenience store and pharmacy shelves to keep products and labels organized and at the front of the shelf, both appealing and accessible to the consumer. This system is modular and changeable, and is easily rearranged to accomodate rows of products of various shapes and sizes, even within a single system unit. The benefits provided by this system may lead to increased product recognition, lower out-of-stocks and inventorying requirements, improved presentations, optimal real estate utilization, and ultimately, increased profits and sales.

4 Claims, 11 Drawing Sheets

ADJUSTABLE PRODUCT DISPLAY AND DISPENSING UNIT

The efficiency and profitability of a retail operation or particular brand of product is a function of sales volume and profit margins. Factors which increase sales include exceptional product displays, constant availability, accessability to the consumer, and optimal use of display space. A system which enhances all of these factors would prove invaluable to the trade.

Past devices have attempted to meet these criteria, some more effectively than others. Units with spring actuated followers which push product to the front are described by U.S. Pat. Nos. 2,110,299 to Hinkle, 1,162,203 to Apfeld, 2,954,128 to Gordon, 2,129,122 to Follett, 2,538,165 to Randtke, and 1,587,936 to Brunhoff. U.S. Pat. Nos. 1,840,297 to Alexander, 4,844,264 to Deskiewicz, and 4,478,337 and 4,454,949 to Flum all provide product, displays which utilize inclined surfaces for gravity to move product to the front of the device. U.S. Pat. Nos. 4,364,481 and 4,460,096 to Ricci provide a shelf organizer which may be varied in width, but not move product to the front of the unit. Most of these devices make inefficient use of space by having a bulky mechanism or requiring an inclined position, both which waste product space and limit the utility of these devices. Inclined devices also point product labels towards the floor; presumably not where the heads of most buyers reside. None of these devices, except Ricci, are adjustable to accomodate products of various widths post-manufacture of the device. No known prior art provides an assembly with a readily changeable number of product spaces of adjustable width which actively repositions product within each product space towards the front of the assembly as units of product are removed at the front side of the assembly.

The present invention provides an adjustable assembly for the storage, organization, display, promotion and dispensing of units of products which requires minimum space, may be placed directly upon a shelf or stacked, is easily adjustable to accomodate the various sizes and shapes of products, maintains product in excellent organization, keeps products and labels at the front of the shelf where they are visible and accessible to consumers, is simple and reliable, and which costs substantially less than the financial benefits conferred by its use.

Figure 1:
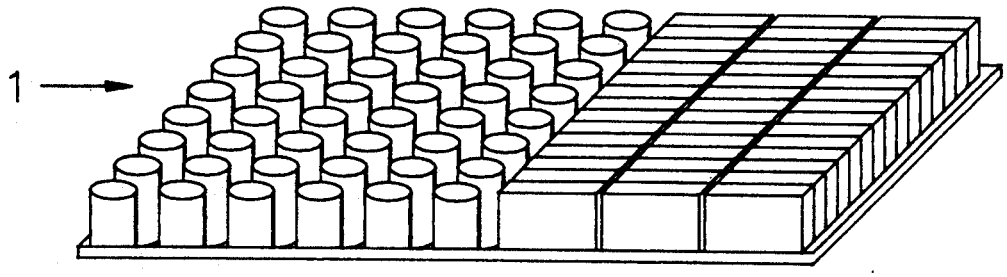

These and other advantages of the present invention will be apparent to those skilled in the art after considering the following specification and claims in conjunction with the drawings accompanying this application:

FIG. 1 shows a perspective view of the invention 1 filled with units of containerized products 9. In this particular drawing the assembly 1 is shown configured for six rows of cans and three rows of boxed products.

Figure 2A:
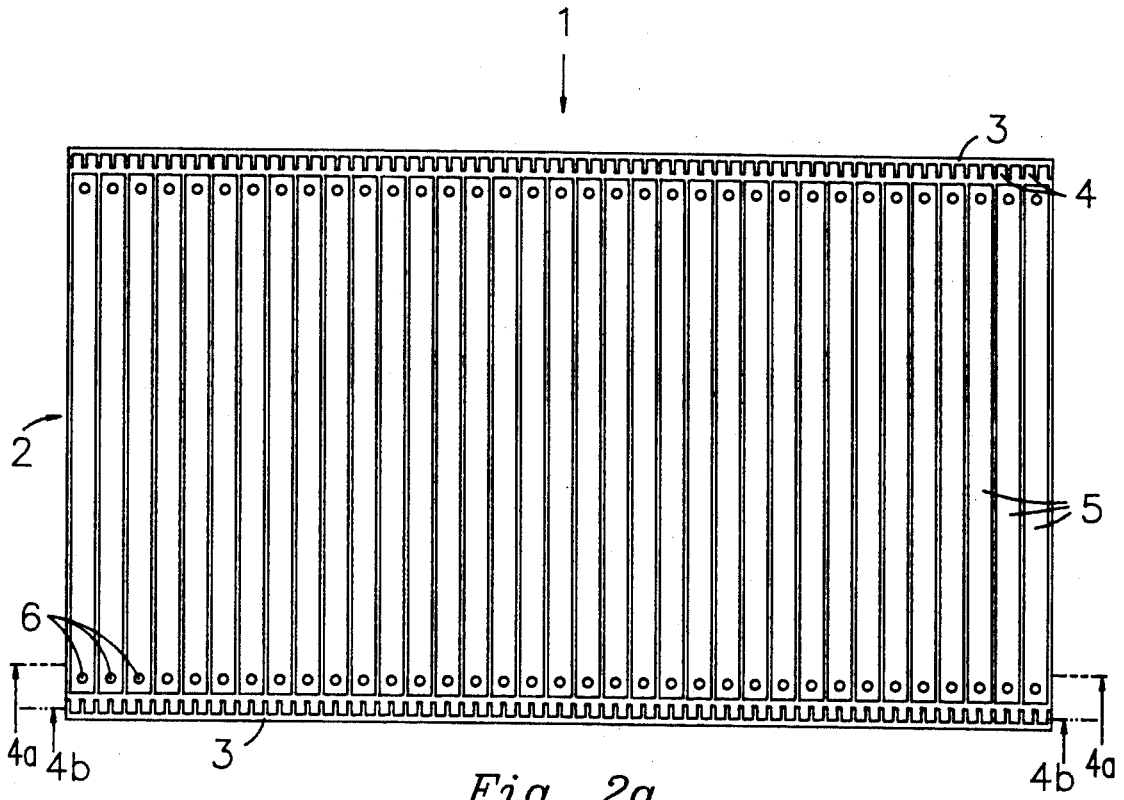
Figure 2B:
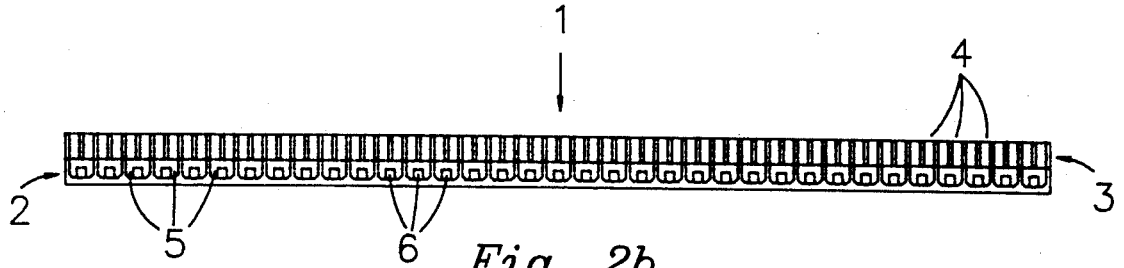
Figure 2C:
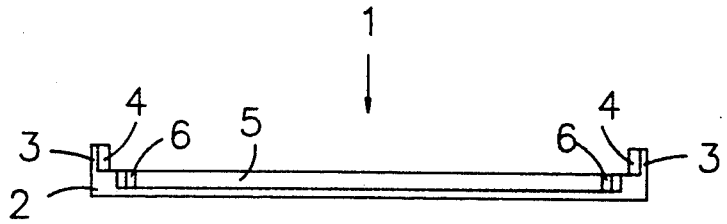

FIGS. 2*a*, 2*b* and 2*c* show top, front and side views respectively of a first preferred embodiment of the assembly of the invention 1 ,including a base portion 2, retaining structure 3 with notches 4, and grooves 5 with pins 6.

Figure 3A:
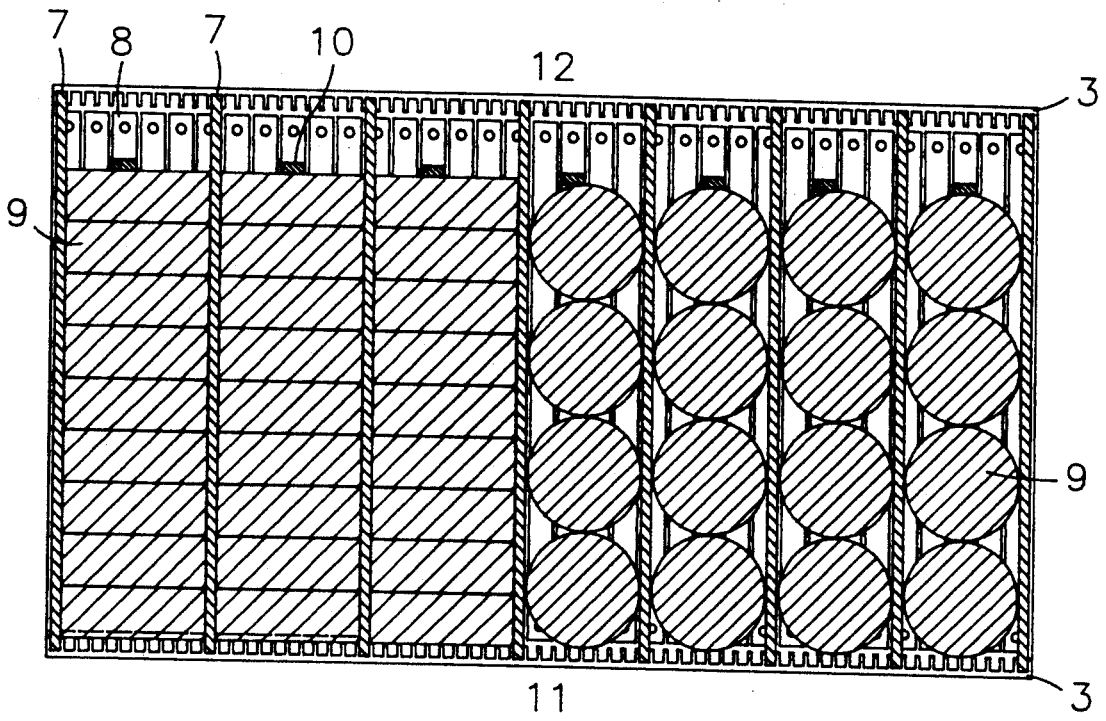
Figure 3B:
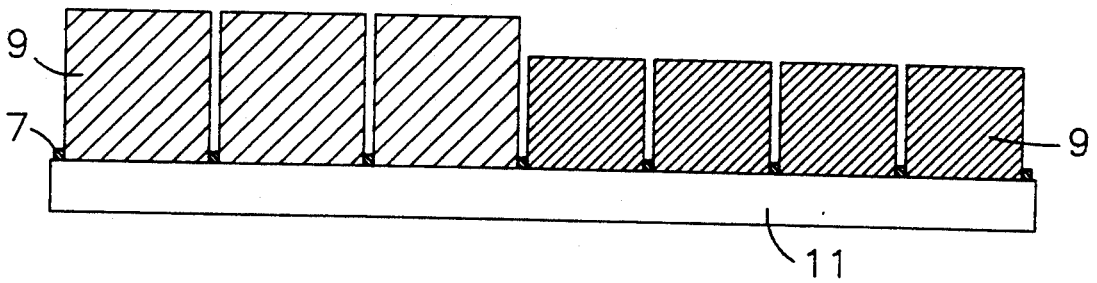
Figure 3C:
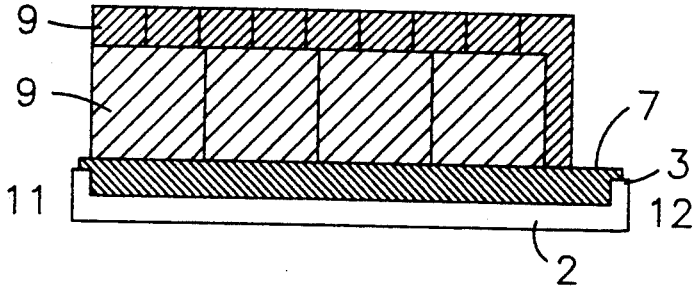

FIGS. 3*a*, 3*b* and 3*c* show top, front and side views respectively of the embodiment of the assembly of the invention 1 shown in FIGS. 2*a*, 2*b*, and 2*c*, including units of containerized product 9 positioned within seven product spaces 8.

Figure 4A:
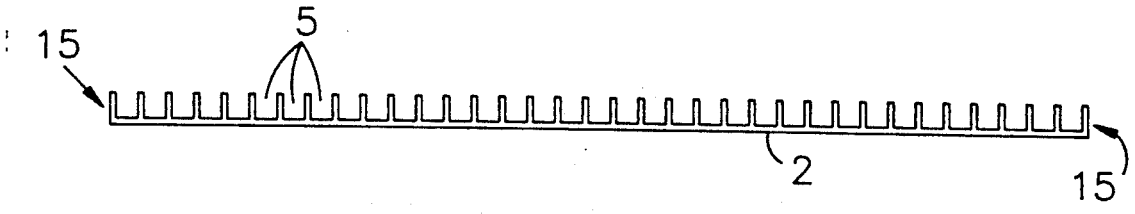
Figure 4B:
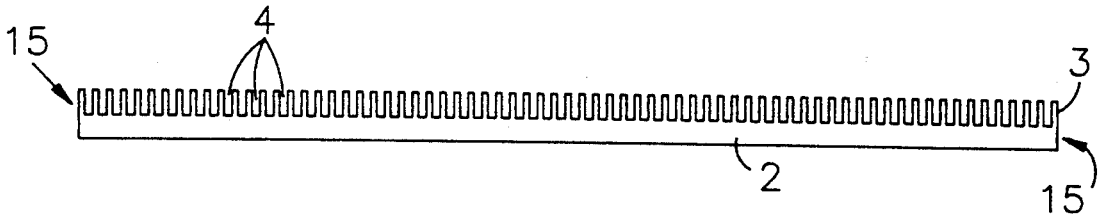

FIGS. 4*a* and 4*b* show cross sectional views of the regions designated 4*a*—4*a* and 4*b*—4*b* respectively in FIG. 2*a*.

Figure 5A:
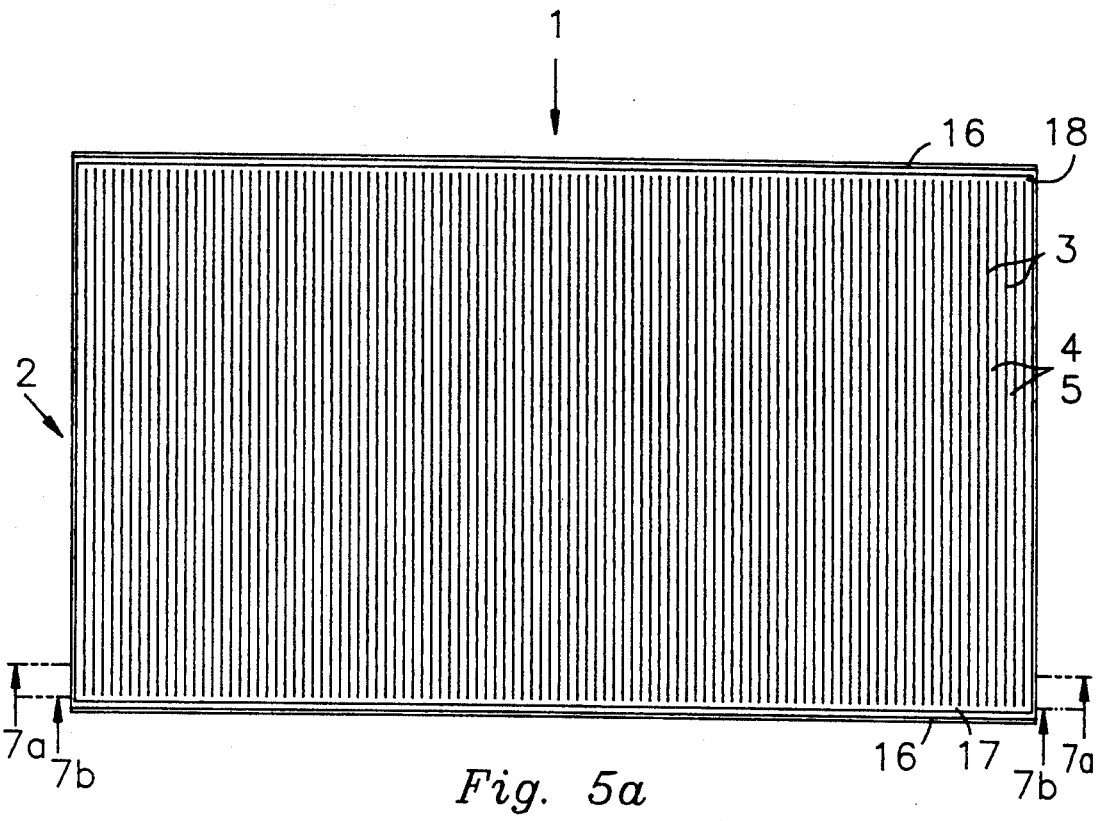
Figure 5B:
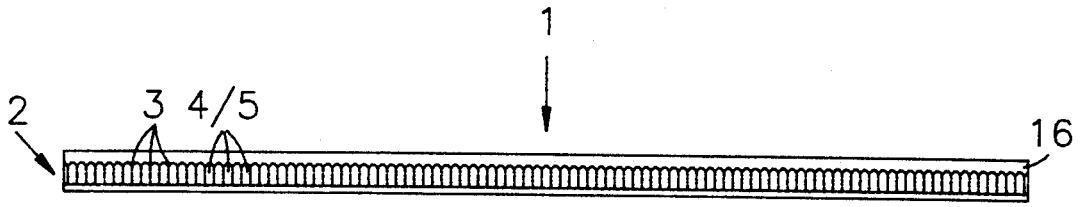
Figure 5C:
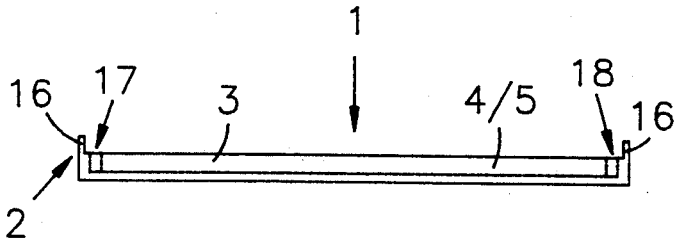

FIGS. 5*a*, 5*b* and 5*c* show top, front and side views respectively of a second preferred embodiment of the assembly of the invention 1, including a base portion 2, and combined grooves 5 and retaining structure 3,4.

Figure 6A:
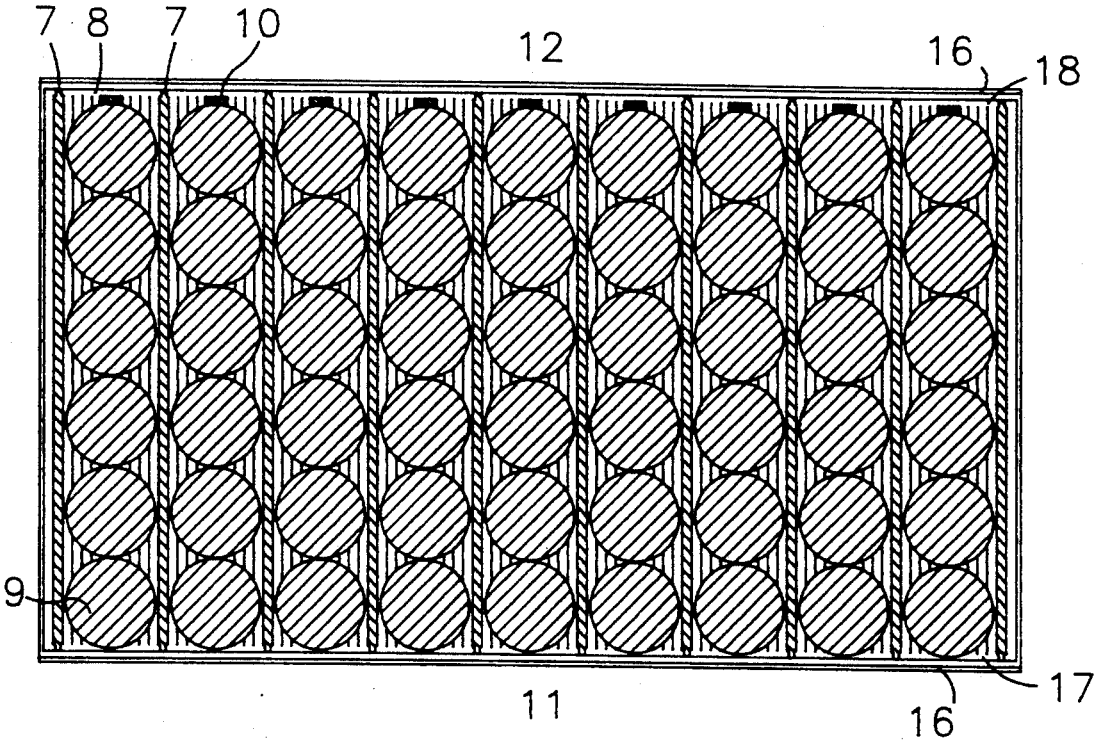
Figure 6B:
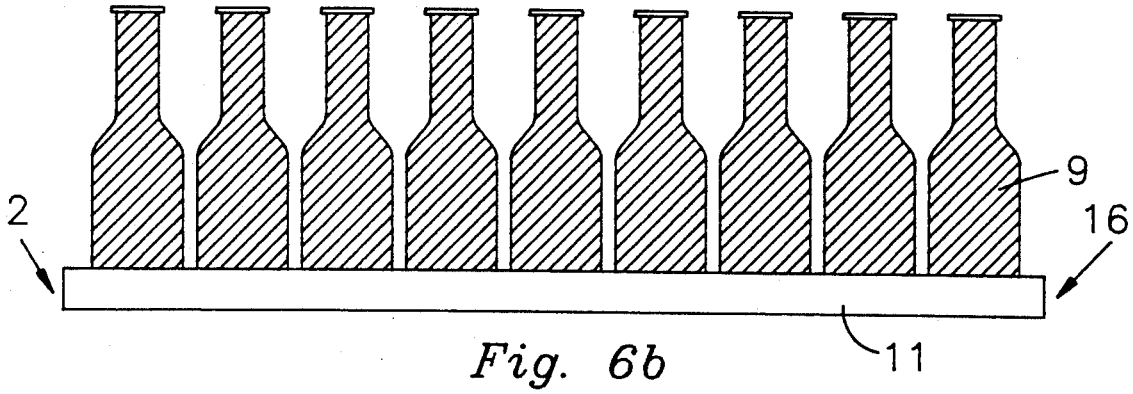
Figure 6C:
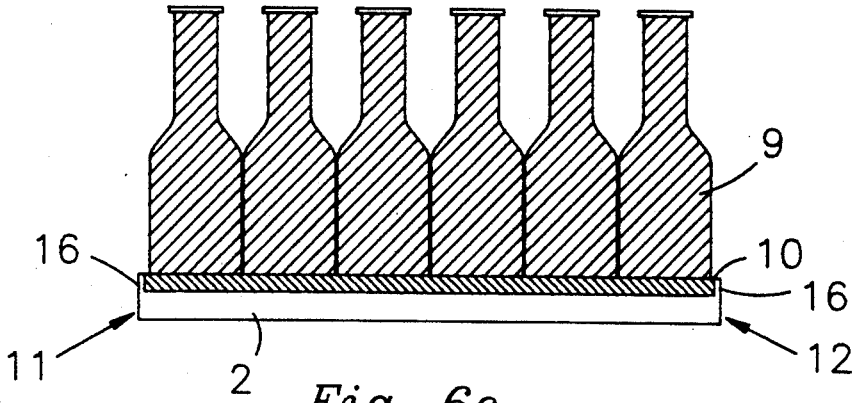

FIGS. 6*a*, 6*b* and 6*c* show top, front and side views respectively of the embodiment of the assembly of the invention 1 shown in FIGS. 5*a*, 5*b*, and 5*c*, including units of containerized product 9 positioned within nine product spaces 8.

Figure 7A:
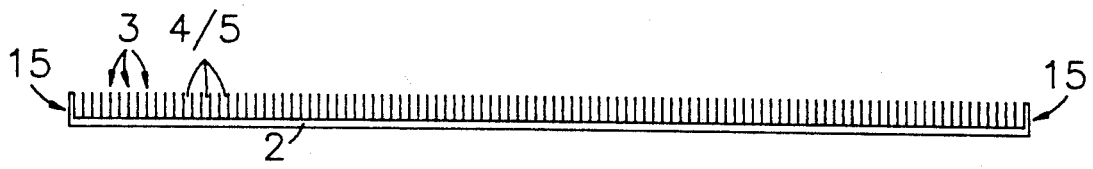
Figure 7B:
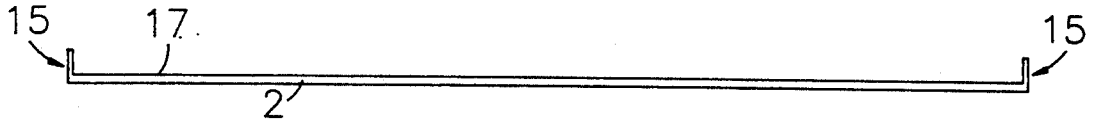

FIGS. 7*a* and 7*b* show cross sectional views of the regions designated 7*a*—7*a* and 7*b*—7*b* respectively in FIG. 5*a*.

Figure 8A:
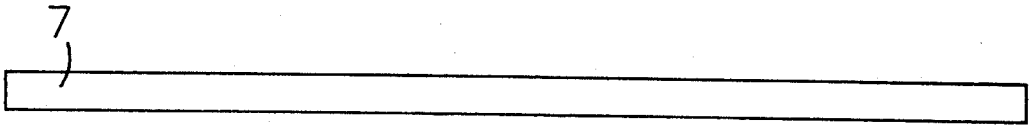
Figure 8B:
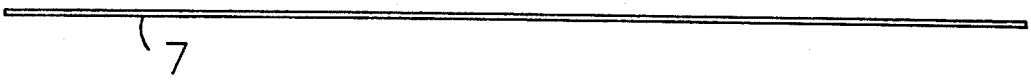
Figure 8C:
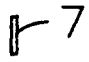

FIGS. 8*a*, 8*b* and 8*c* show side, top and end views respectively of one preferred embodiment of a row divider 7 which may be positioned within either retaining structure embodiment 3, as shown in FIGS. 2 and 5.

Figure 9A:
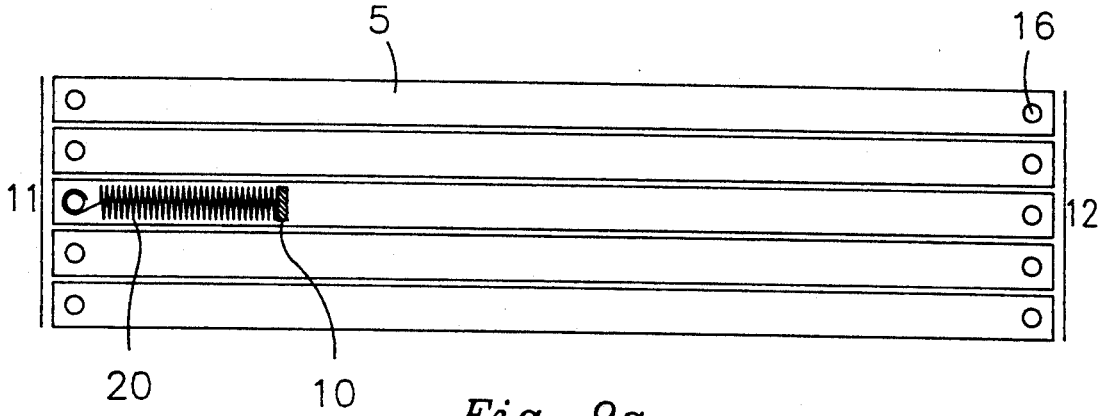
Figure 9B:
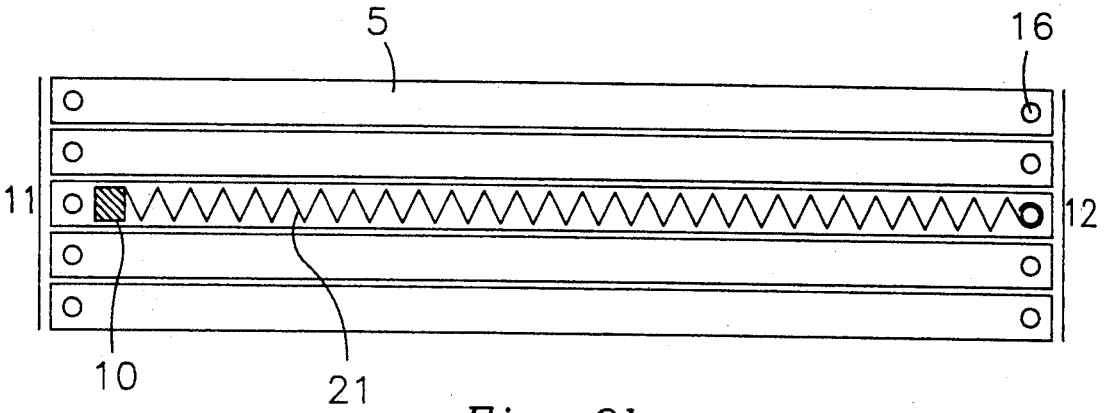
Figure 9C:
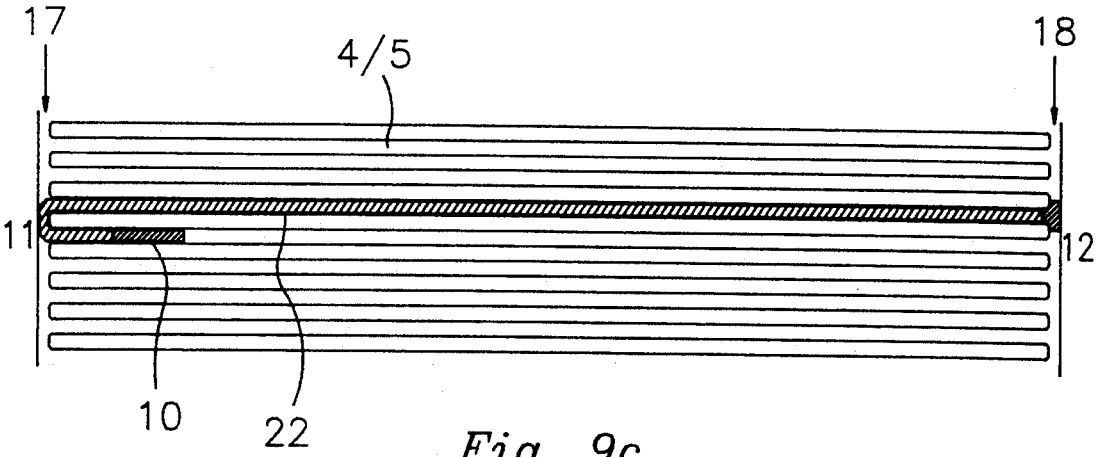

FIGS. 9*a*, 9*b* and 9*c* show top views of base portion grooves 5 and three of many possible variations for a mechanism of the assembly. FIG. 9*a* shows a contracted spring mechanism 20 which could be stretched in order to have its tab portion 10 contact a rear most unit of product 9 in a row of the assembly 1. FIG. 9*b* shows an expanded spring mechanism 21 which could be compressed in order to have its tab portion 10 contact a rear most unit of product 9 in a row of the assembly 1. FIG. 9*c* shows a doubled back elastic band mechanism which is stretched back to have its tab portion 10 contact a rear most unit of product 9 in a row of the assembly 1.

Figure 10A:
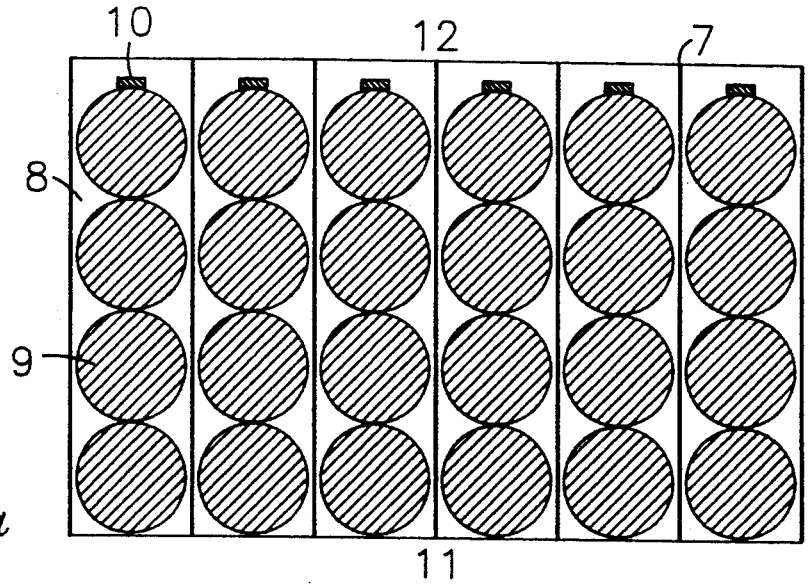
Figure 10B:
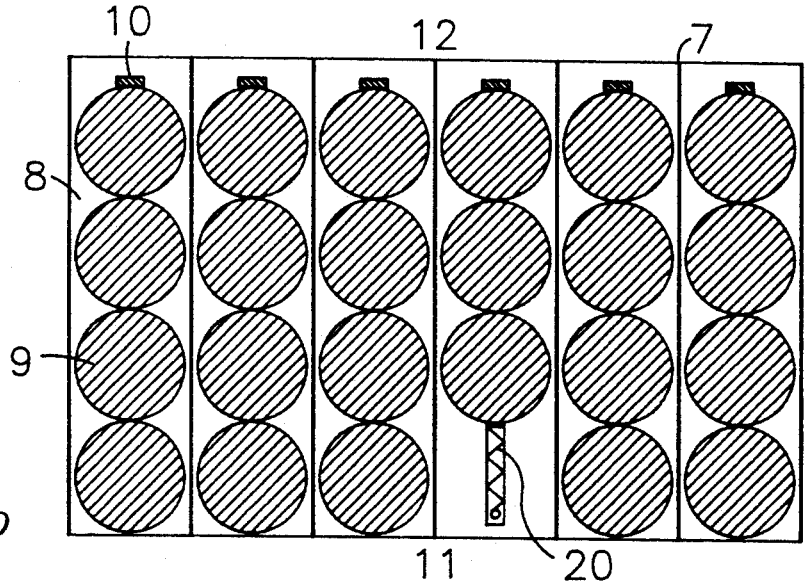
Figure 10C:
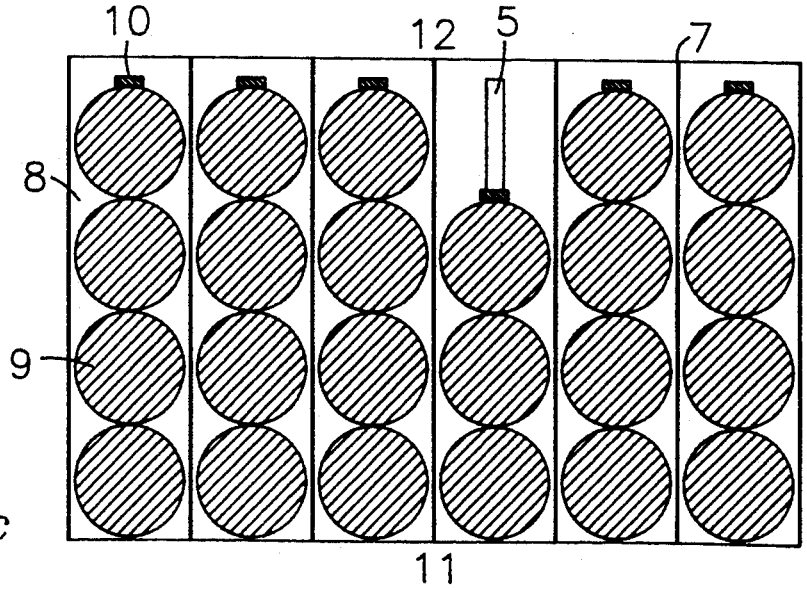

FIGS. 10*a*, 10*b* and 10*c* show a highly simplified diagram of the invention 1 with only one groove 5 and one mechanism 20 presented. FIG. 10*a* shows the assembly configured for and containing six rows of product 9.

FIG. 10*b* shows the assembly of FIG. 10*a* with a single unit of product 9 removed from the front side 11 of the assembly. FIG. 10*c* shows the assembly of FIG. 10*b* after repositioning of the row of product 9 towards the front of the assembly by the mechanism 20. This sequence may also be considered in reverse order to illustrate addition of a unit of product to the assembly at the assembly front side.

Figure 11:
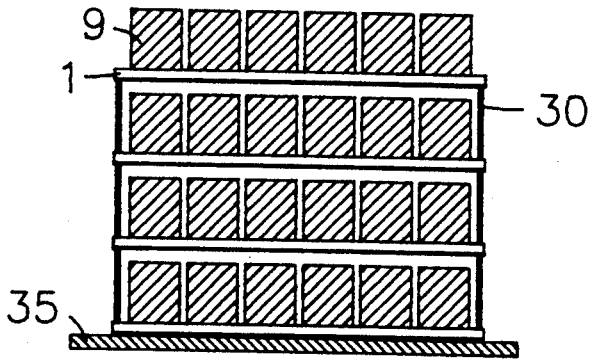

FIG. 11 shows four assembly units 1, each containing product 9, which are stacked one above another, as may be arranged on a shelf with the aid of a stacking support structure 30. The stacking support structure 30 shown in this figure is a sheet of lightweight metal formed in an inverted U-shape and positioned between vertically adjacent assemblies 1.

Figure 12:
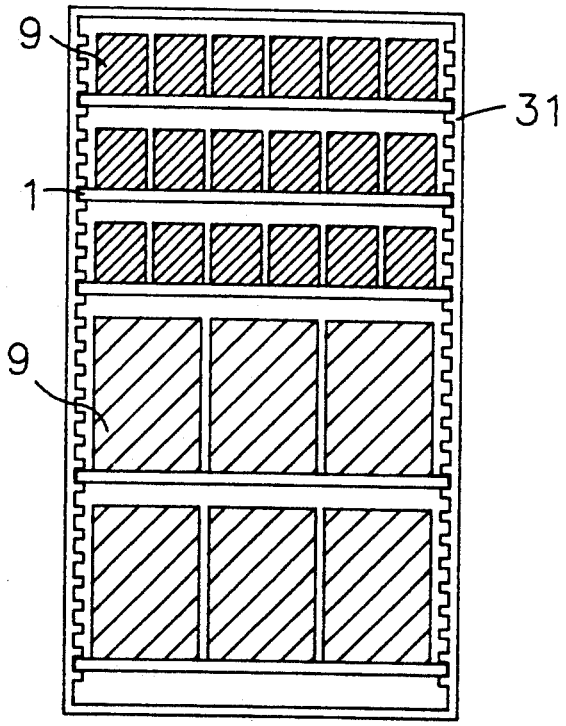

FIG. 12 shows five assembly units 1 positioned within a rack structure 31. The rack structure 31 shown has inward facing grooves which slidably accept assemblies 1 at selectively adjustable vertical positions.

One preferred embodiment of the present invention 1, shown in FIGS. 2 through 4, consists of a generally rigid, flat, and rectangular base portion 2 with a retaining structure 3 which receives and securely retains selectively positionable row dividers 7. Each row divider extends from the front to the rear of the base portion 2, and may be positioned in parallel with other row dividers 7 located in the assembly. A product space 8, where units of product 9 may be lined up in a row from front 11 to rear 12 sides of the assembly 1, is created between two adjacent row dividers 7. The number of row dividers 7 used in an assembly 1 determines the number of product spaces 8 available. For example, an assembly 1 with six row dividers 7 positioned in the unit 1 may have five product spaces 8 available for five rows of product 9. These product space 8 may be of the same or different widths, depending upon the spacing between adjacent row dividers 7. Row dividers 7 may be repositioned, added to, or removed from assembly 1 to adjust the number and width of product spaces 8 in a particular assembly 1.

Additionally, just as row dividers 7 are rearrangeable to accomodate the various shapes and sizes of product 9, mechanisms 20,21, or 22 used in assembly 1 to reposition rows of product 9 are also moveable within the assembly 1. This is done to assure that, in the standard configuration, each product space 8 has one mechanism 20,21, or 22 associated with it at or near a preferred centerline position.

To provide for this, the base portion 2 includes a plurality of parallel, spaced grooves 5, each groove extending from front to rear of the base portion 2. Grooves 5 are intended to receive and securely retain a spring or other type of mechanism 20,21, or 22 to either push or pull rows of product 9 towards the front 11 of the assembly 1 by means of a tab portion 10. For each product space 8 created, a mechanism 20,21, or 22 may be placed into the groove 5 located nearest the centerline of that product space 8 to service product contained within that product space 8. This mechanism 20, 21, or 22 may be removed, repositioned or replaced as required. Grooves 5 may also have retaining pins or plates 6 to secure one or both ends of a mechanism 20,21, or 22 in place. Grooves 5 used for retaining mechanisms 20,21, or 22 may also be utilized as retaining structure 3 and notches 4 used to retain dividing walls 7.

The base portion 2 is preferably a molded or formed plastic material such as high impact polystyrene or polycarbonates. These materials may be impregnated or mixed with silicone to improve surface characteristics. The chosen material should be fairly rigid, have a relatively low friction surface, and be otherwise suited for the intended applications of the invention 1, including possible use in supermarket refrigerated or frozen sections. The base portion 2 may be manufactured in a wide range of sizes, although preferred sizes match standard supermarket, pharmacy, and convenience store shelf dimensions in order that units fit securely on shelves and make optimal use of all available space. One preferred unit size is forty-eight inches wide, twenty inches deep, and one-quarter inch thick. Units would be placed side-by-side and stacked along entire lengths of shelving, as required. This provides a flexible, user-friendly display environment.

The base portion 2 is designed with a retaining structure 3 which enables secure positioning of row dividers 7. The retaining structure 3 may be designed in a variety of ways, including holes or grooves in the base portion 2. The retaining structure 3 may also simply be the mechanism grooves 5, with row dividers 7 occupying some grooves 3,5 and mechanisms 20,21, or 22 occupying some others. One preferred retaining structure 3 includes two parallel, upstanding walls arising from the upper surface of the base portion 2, one each located along the front 11 side and rear 12 side of the assembly 1. This retaining structure 3 includes a plurality of evenly spaced, vertical, inward facing notches 4 which accomodate row dividers 7 which may be slidably positioned within selected notches 4. In addition, the preferred retaining structure 3 provides a rim to prevent product 9 from being pushed off the front 11 or rear 12 sides of the unit 1.

Row dividers 7 are elongated structures used to create product spaces 8 and to help guide product 9 towards the front 11 of the assembly 1 as product 9 is gently pushed from behind. Row dividers 7 may be made of the same material as the base portion 2, or another material such as metal or cardboard. Row dividers 7 must associate securely with the retaining structure 3. One preferred design for a row divider 7 is a flat strip of aluminum with length equivalent to the distance from within a notch 4 in the rear retaining structure element 3 to within a corresponding notch in the front retaining structure element 3. The height of this row divider 7 would be 0.35 inches and it would have a thickness of approximately 0.07 inches. Other designs might include circular wooden dowels which fit into indentations, or plastic bars with square cross-section which slide into a saw-toothed surface on the retaining structure 3. The width of row divider 7 determines lateral product 9 separation and, along with product width, the number of product facings possible per given frontage. Thin row dividers 7 may be placed close together to create spacing between adjacent product spaces 8. Some space between adjacent rows of product 9 may be desirable to facilitate grasping and removal of product from the assembly 1 by the consumer.

Grooves 5 in the base portion 2 are designed to accomodate mechanisms 20, 21, or 22 at selectively variable positions, depending upon the positioning and number of row dividers 7. In the standard configuration, one mechanism 20,21, or 22 is associated with each product space or row of product 8. The grooves 5 are preferably closely spaced indentations in the top surface of the base portion 2, and are aligned from front to rear of the assembly 1 and parallel to the desired direction of product 9 movement. For a base portion 2 of 0.25 inches thickness, associated grooves 5 may have a width and depth of 0.20 inches and length extending from near the rear side 12 of the unit to near the front side 11 of the unit. These grooves 5 may be spaced 0.10 inches apart. Strips of material remaining between adjacent grooves 5 provide a low-friction supporting structure for product 9 placed upon the assembly 1. Furthermore, grooves 5 may contain retaining pin or plates 6 to securely retain a spring-loaded 20,21 or other type 22 of mechanism in place within groove 5. A slight tapering of the upper sides of the grooves 5 may be desirable to help maintain a mechanism 20,21, or 22 in place within the groove 5. Holes in the bottom surface of the grooves 5 extending through the base portion 2 bottom may be desired for improved air circulation around product 9 contained in the assembly 1.

Note that the preferred system unit base portion 2 is symmetrical and may therefore be simply turned around should the original front side of the assembly 1 be improperly labeled or become damaged.

A mechanism has the intended purpose of gently applying force against a rearmost unit of product 9 within each product space 8 to reposition the entire row of product 9 towards the front 11 of the system assembly 1 as preceding units of product 9 are removed. Many mechanism types are possible. One preferred mechanism 20 includes a spring sized to fit within a described groove 5 located at or near the centerline of each product space 8. A first end of mechanism 20 attaches to a retaining pin or plate 6 located within groove 5 to hold it securely in place. A second end of the mechanism 20 spring, which is modified to have a tab portion 10 which extends out of groove 5 in order to contact the last unit of product 9 in a given row, is positioned such that the tab portion 10 contacts the back side of the rearmost unit of product 9 within that product space 8. As product 9 is removed from that product space 8 at the front of the assembly 1, the mechanism 20 gently contracts to pull the row of one or more units of remaining product 9 forward, by means of its modified second end tab portion 10, towards the front 11 of the assembly 1. This basic process is shown in FIGS. 10*a*–10*c*.

A second preferred embodiment of this invention 1, shown in FIGS. 5 through 7, is very similar in design to the first preferred embodiment, but includes two additional grooves, a front groove 17 which connects the front ends of the mechanism grooves 5 at the front side 11 of the unit 1, and a rear groove 18 which connects the back ends of the mechanism grooves 5 at the rear side 12 of the unit 1. This second preferred embodiment does not include the retaining mechanism design shown for the first preferred embodiment. This second preferred arrangement enables a mechanism, such as an elastic band or bungee cord 22 to be secured at and extend from the rearmost end of one mechanism groove 5 to the front end of that same groove, into the described front groove 17 of this embodiment, and then continue back towards the rear side of the unit within a second mechanism groove 5. This unsecured, second end has a tab portion 10 which extends out of the mechanism groove 5 and into the product space 8 to contact a rearmost unit of product 9 and move the associated row of product within that product space 8 towards the front 11 of the unit 1 as permitted by the removal of units 9 of product at the front side 11 of the assembly 1. A raised rim 16 at the front side 11 and back side 12 of the top surface of assembly 1 provides a barrier to keep product 9 from being pushed off the assembly 1. This second preferred embodiment allows for smaller groove 5 widths and spacing, accomodating thinner mechanisms 22, and the ability to use the mechanism grooves 5 to receive and retain row dividers 7 which may be slidably positioned therein. Mechanisms 22 would occupy some grooves while row dividers 7 would occupy some others.

The doubled back cord mechanism 22 of the type described for this second preferred embodiment of the invention 1 may also be used with the groove 5 arrangement of the first preferred embodiment of the invention 1 by having the cord or band turn about an upstanding plate or pin 6 at the front end of the groove 5. This type of mechanism 22 offers two potentially significant benefits. First, the band is only stretched to only approximately two times its original length during operation of the mechanism 22. This may reduce wear on this type of mechanism 22 and increase its operational life. Second, this arrangement may allow for continuous and instantaneous inventory indications for each row of product 9 by having the cord or band imprinted or otherwise marked, and by providing holes at the front side 11 of the assembly 1 for visualization of the cord or band. A change in color from white to red, for example, might indicate that restocking is required. Otherwise, the number of units of product remaining in a row 8 is readily determined by manually pushing back on a row of product 9 to check the amount of empty space existing in the product space 8.

Beyond the uses already described for this invention, it is envisioned that this system may be utilized as a combined primary package and shelving/display unit, thereby providing a reusable alternative to cardboard boxes and saving time and labor costs by enabling the direct shelving of entire cases of products onto shelves or into rack structures without necessitating removal and stocking of individual units of product. This variation of the invention may include a recessed region in the bottom surface of the invention to allow for secure stacking of loaded units, as well as tabs and receiving holes for the orderly stacking of empty units. Side grooves may be provided to enable system units to be moved securely into and out of universal racks.

This invention, in its basic form or as a part of an integrated logistical and promotional system, is highly desirable for a number of reasons. Boxes, bottles, jars and cans are kept organized with labels showing at the front of the shelf. Shelving of products is faster and easier, and more product can be kept on the shelf where it belongs. This, in turn, reduces lost sales due to out-of-stock items or unappealing, consumer ravaged displays by keeping items accessable and maintaining displays in impeccable order.

In addition to the mechanics of the system, units may be modified to give merchandisers optimal point-of-purchase control. This is accomplished by imprinting logos on units, color-matching assemblies to create eye-catching displays, or otherwise labeling system units for increased product or brand promotion. Square shape base units may be stacked as stand alone displays having facings in all four directions. Stickers or tags are easily attached to system units. If desired, system mechanisms will even display signs such as "Out of stock" or "Thank you for buying [logo]", should a row of product become empty.

This present invention is intended for use in supermarkets, convenience stores, grocery stores, pharmacies and other retail operations. This system may also prove beneficial for industrial or consumer storage applications. Assemblies 1 may be used in conjunction with support structures 30 (FIG. 11) for the purpose of stacking units upon one another to minimize the amount of shelf structure required. Furthermore, units may be designed to be hung or otherwise supported within a rack 31 (FIG. 12) or other structure. Inclined units may be used without mechanisms. All of these capabilities provide a high degree of flexibility for the design of extremely effective product displays while promoting optimal real estate utilization.

Alterations, variations and additional applications of the present invention will be apparent to those skilled in the art after review of this document. All such alterations, variations and additional applications consistent with the spirit and scope of this invention are deemed to be covered by the invention and claims which follow.

What is claimed is:

1. An adjustable assembly for the storage, display, and dispensing of units of containerized products comprising:

A. a generally rectangular base portion having top and bottom facings, front side, rear side, and opposed lateral sides;

A'. retaining structure comprised of multiple, spaced grooves:

A". one or more selectively positionable and replaceable product repositioning mechanisms, each comprising resilient means for supplying force for product repositioning:

A'''. one or more selectively positionable and replaceable row dividers, said assembly being further characterized by:

B. said retaining structure being capable of receiving and retaining said row dividers and said product repositioning mechanisms, such that said row dividers occupy some said grooves of said retaining structure while said product repositioning mechanisms occupy other said grooves of said retaining structure:

C. each row divider extending approximately from said front side to said rear side of said base portion and being selectively movable and positionable in parallel with other said row dividers to thereby define a selectively adjustable number of product spaces of adjustably variable width between adjacent said row dividers;

D. said assembly base portion including an upstanding rim at said top facing front and rear side edges to maintain said product within said product spaces, and having no said rim at said top facing opposed lateral side edges to thereby permit side-to-side connection of two said assemblies to provide a said product space which may span and exist partly in each of two said connected assemblies:

E. each said assembly product repositioning mechanism residing substantially entirely within said assembly base portion and product space, and having said mechanism resilient means reside substantially entirely within said base portion such that said resilient means resides below any said units of containerized product positioned within said product space, and;

F. each said product repositioning mechanisms being capable of automatically repositioning said product towards said assembly front side without requiring said assembly to be supported in an inclined position.

2. An adjustable assembly for the storage, display, and dispensing of units of containerized products comprising:

A. a generally rectangular base portion having top and bottom facings, front side, rear side, and opposed lateral sides;

A'. retaining structure comprised of multiple, spaced grooves:

A''. one or more selectively positionable and replaceable product repositioning mechanisms, each comprising resilient means for supplying force for product repositioning:

A'''. one or more selectively positionable and replaceable row dividers, said assembly being further characterized by:

B. said retaining structure being capable of receiving and retaining said row dividers and said product repositioning mechanisms, such that said row dividers occupy some said grooves of said retaining structure while said product repositioning mechanisms occupy other said grooves of said retaining structure:

C. each said row divider extending approximately from said front side to said rear side of said base portion and being selectively moveable and positionable in parallel with other said row dividers to thereby define a selectively adjustable number of product spaces of adjustably variable width between adjacent said row dividers;

D. said base portion grooves extending approximately from said front side to said rear side of said base portion;

E. said assembly base portion grooves further having means to securely and removeably accept and retain one or more said product repositioning mechanisms;

F. said assembly base portion grooves being further capable of selectively and removably receiving and retaining said product repositioning mechanism resilient means portion substantially entirely within said assembly base portion such that said resilient means resides below any said units of containerized product within said product space, and;

G. said product repositioning mechanisms automatically repositioning said product towards said assembly front side without requiring said assembly to be supported in an inclined position.

3. The assembly of claim 1 having said row dividers comprised of elongated, relatively flat strips of material.

4. The assembly of claim 1 having said row dividers comprised of elongated strips of material with a significantly rectangular cross section.

* * * * *